US005509649A

United States Patent [19]

Buhrkuhl

[11] Patent Number: 5,509,649

[45] Date of Patent: Apr. 23, 1996

[54] DEVICE AND METHOD FOR MEASURING THE VELOCITY AND ZONAL POSITION OF A PITCHED BALL

[76] Inventor: David R. Buhrkuhl, 861 Timberwood La., Fairview, Tex. 75069

[21] Appl. No.: 321,216

[22] Filed: Oct. 11, 1994

[51] Int. Cl.[6] ..... A63B 69/00

[52] U.S. Cl. ..... 273/26 A

[58] Field of Search ..... 273/26 A

[56] References Cited

U.S. PATENT DOCUMENTS

| | | | |
|---|---|---|---|
| 3,229,975 | 1/1966 | Tompkins et al. | 273/26 A |
| 3,497,683 | 2/1970 | Jordan et al. | 235/92 |
| 3,633,909 | 1/1972 | Doynow | 273/26 A |
| 3,902,804 | 9/1975 | Baxter | 356/28 |
| 4,180,726 | 12/1979 | DeCrescent | 250/222 R |
| 4,563,005 | 1/1986 | Hand et al. | 273/26 R |
| 4,657,250 | 4/1987 | Newland et al. | 273/26 A |
| 4,770,527 | 9/1988 | Park | 356/28 |
| 4,949,972 | 8/1990 | Goodwin et al. | 273/371 |
| 4,961,643 | 10/1990 | Sakai et al. | 356/28 |
| 5,067,718 | 11/1991 | Knox et al. | 273/185 R |
| 5,230,505 | 7/1993 | Paquet et al. | 273/26 A |
| 5,401,016 | 3/1995 | Heglund et al. | 273/25 |

*Primary Examiner*—William H. Grieb

*Attorney, Agent, or Firm*—P. Weston Musselman, Jr.; Robert A. McFall; Jenkens & Gilchrist

[57] ABSTRACT

A plurality of electromagnetic energy transmitters and receivers are each arranged in a respective linear array to define a single vertical plane. A portion of the transmitters are coupled together to define a field, or strike zone, within the plane. The device has a means for detecting the entrance and exit of a ball into and from the single plane and for simultaneously detecting whether the ball was within, or outside of, the strike zone. The method for measuring the velocity and zonal position of a pitched ball includes sensing the entrance and exit of a ball into and from a single spatial plane, generating a series of count signals, and measuring the number of count signals occurring during passage of the ball through the plane. Simultaneously with measuring the number of count signals, the passage of the ball either through or outside of the strike zone is sensed, and a signal indicative of the position of the ball with respect to the strike zone is displayed.

17 Claims, 9 Drawing Sheets

DEVICE AND METHOD FOR MEASURING THE VELOCITY AND ZONAL POSITION OF A PITCHED BALL

TECHNICAL FIELD

This invention relates generally to a device and method for measuring the speed and relative position of an object in flight, and more particularly to such a method that simultaneously measures the velocity and zonal position of a pitched ball passing through a single spatial plane defined by the device.

BACKGROUND ART

It has long been a desire of pitchers, coaches, trainers and others involved in baseball and softball to have a relatively inexpensive, easy to use and accurate device that could not only measure the speed of a pitched ball, but also whether it was in the strike zone. Radar guns, if properly used, can measure the velocity of a pitched ball, but cannot tell if the pitch was a ball or strike.

A number of devices have been proposed for measuring both the velocity and position of objects in flight. For example, U.S. Pat. No. 4,563,005 issued Jan. 7, 1985 to Richard A. Hand describes a device for computing the speed and location of a baseball as it is pitched over a plate. This device uses two vertical arrays of infrared transmitters to establish two parallel planes through which the ball must pass. The speed of the ball is determined by measuring the time it takes for the ball to pass through the zone between the parallel planes, and the coordinate position of the ball is calculated by computer circuitry based on a preprogrammed table of angular data. This device requires 128 emitters, 8 receivers, and a central processing unit with access to a program stored in a read only memory device. Thus, this unit is inherently expensive, and has three major components that must be interconnected prior to operation. Further, the device requires considerable electrical energy to drive the large number of emitters and the computer. These disadvantages render the device undesirable portable operation, especially at a location which is dependent on a battery source for electrical power.

Another device for evaluating ball pitching performance, described in U.S. Pat. No. 5,230,505 issued Jul. 27, 1993 to Ghislain Paquet et al, uses two arrays of infrared emitters and two arrays of corresponding infrared receivers to form a three dimensional system bounded by two planes. The device is housed in a framework that forms a corridor with a display unit disposed near a forward end of the corridor and the three dimensional measuring zone disposed adjacent the rearward end. Thus this device similarly requires a significant amount of electrical energy to operate, and its unwieldy size makes it similarly unsuitable for portable operation at sites remote from a source of electrical energy A device for measuring the velocity and position of an object in flight is described in U.S. Pat. No. 4,770,527, issued Sep. 13, 1988 to Kyung T. Park. The Park device uses two arrays of transmitters and receivers, aligned at right angles in a single plane, and an impact sensor formed of a sheet of piezoelectric polymer material having layers of electroconductive material on the front and back. The velocity of the object is calculated by measuring the time lapse between interruption of the plane and contact with the impact sensor. The position of impact is determined by dividing the impact sensor into a plurality of zones and then sensing the zone struck by the object. It is believed that an impact sensor as proposed by Park would inherently have a short life when repeatedly struck by a baseball traveling at a speed of 80 to 90 mph.

A device for measuring the velocity of an object in motion, and the change of velocity of the object as it passes through a zone bounded by parallel planes is described in U.S. Pat. No. 4,180,726 issued Dec. 25, 1979 to Ronald DeCrescent. In addition to requiring two detection planes, the DeCrescent device cannot determine the lateral position of the moving object as it passes through the zone. Thus, this device would be unsuitable for determining the zonal position of a baseball.

The present invention is directed to overcoming the problems set forth above. It is desirable to have a method for simultaneously determining the velocity and zonal position of a baseball as it passes through a single vertical plane. It is also desirable to have a rugged, relatively inexpensive device for carrying out that method comprising only a single linear array of transmitters and receivers and which can be powered for an extended period of time by electrical energy stored in a conventional battery. Furthermore, it is desirable to have such a device in which all of the components are advantageously assembled together in a single unit that is easily transportable to a desired site, either indoors or outdoors.

DISCLOSURE OF THE INVENTION

In accordance with one aspect of the present invention, a device for measuring the speed and zonal position of a pitched ball has a plurality of electromagnetic energy transmitters and receivers each arranged in a single linear array to define a single vertical plane. A portion of the electromagnetic energy receivers are coupled together to define a field with the plane. The device also includes a means for detecting the entry and exit of a ball passing through the plane and simultaneously detecting the passage of at least a portion of the ball through the field within said plane.

Other features of the device embodying the present invention include a first signal generator that delivers a drive signal to a first portion of the electromagnetic energy transmitters in a first phased relationship with a time signal having a preselected frequency, and a second signal generator that delivers a drive signal to a second portion of the electromagnetic transmitters in a second phased relationship with the time signal. The first and second phased relationships are separated by a half period of the time signal frequency.

In another aspect of the present invention, a method for measuring the velocity and zonal position of pitched ball includes sensing the entrance and exit of a ball in flight into and from a single spatial plane, generating a series of count signals at a predetermined frequency selected to correlate with the diameter of the ball and the elapsed time occurring during the passage of the ball through a single spatial plane at a preselected velocity. The number of counts occurring between the sensed entrance into and exit from the single spatial plane is measured and the velocity of the ball, based on the number of measured count signals, is determined and displayed. Simultaneously with measuring and determining the velocity of the ball, the passage of the ball either through or outside of a predefined planar field within the plane is sensed, and a signal indicative of the ball with respect to the planar field at the time of passage through the plane is displayed.

Other features of the method embodying the present invention include sensing the ambient light environment in which the steps of sensing the entrance and exit of the ball through the spatial plane are carried out, generating a reference signal correlating with the ambient light environment, emitting a plurality of pulsed electromagnetic energy signals, and sensing the emitted signals. The reference signal is compared with each of the sensed emitted electromagnetic energy signals, and the number of count signals occurring during a period in which any one of the sensed emitted pulsed electromagnetic energy has a value greater than the value of the reference is measured.

BEST MODE FOR CARRYING OUT THE INVENTION

Figure 1:
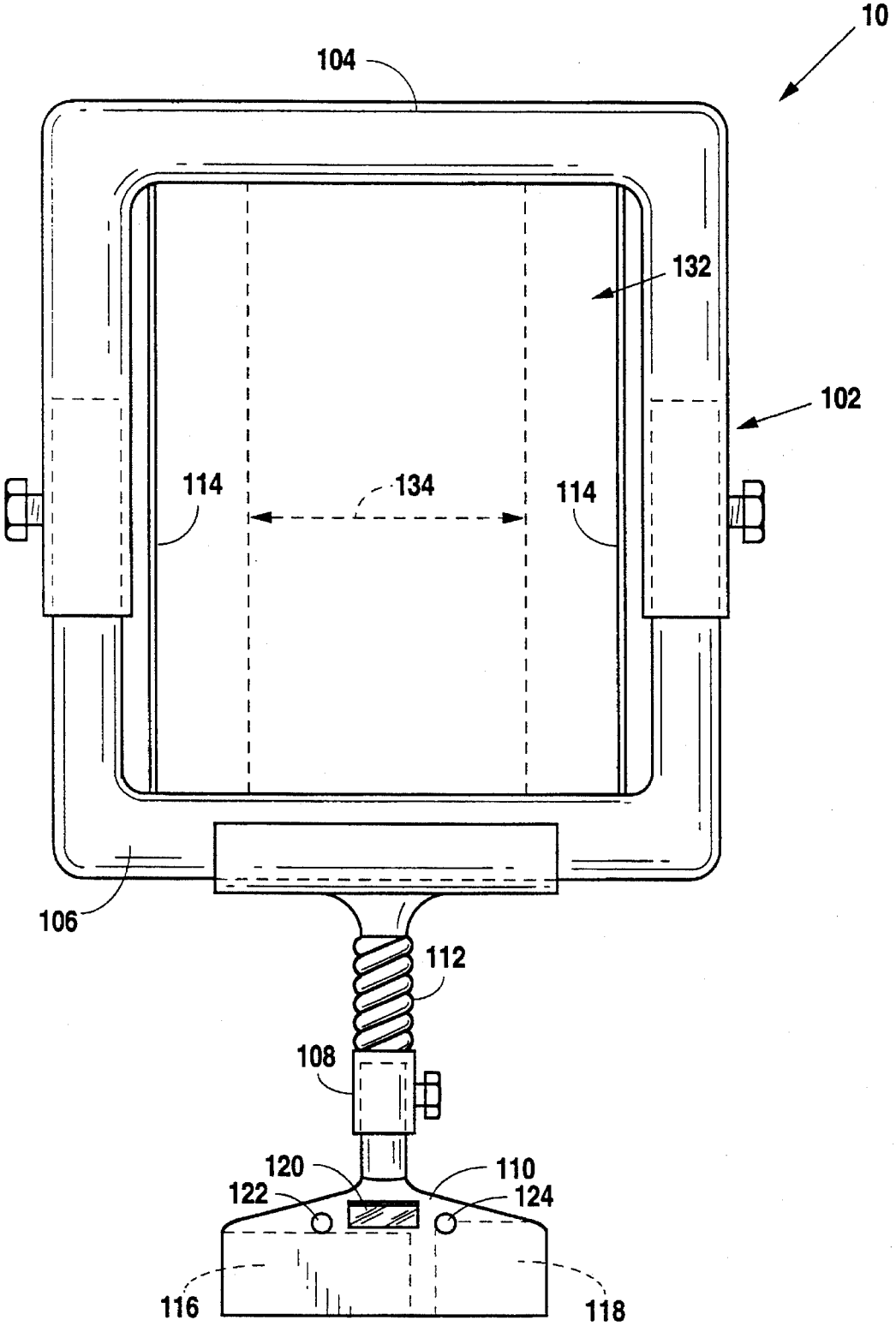
FIG. 1 is an elevational view of a device, embodying the present invention, for measuring the velocity and zonal position of a pitched ball.

A device 100 for measuring the velocity, or speed, of a pitched ball, and the zonal position of the ball, includes a frame 102 desirably having an upper and a lower U-shaped tubular member 104,106. Each of the tubular members 104,106 have a center horizontal component with telescoping side members extending vertically from each side of the horizontal components of the frame 102. The side members are elevationally adjustable with respect to each other so that the center horizontal components of the frame 102 can be selectively vertically spaced apart by a distance corresponding with the desired height of a target strike zone. Typically, the strike zone for an adult batter is approximately 30 to 36 inches (0.76 to 0.9i m).

The lower frame member 106 is mounted on a support post 108 attached to a base member 110. Preferably, the support post 108 is at least partially formed of a resilient spring 112, or similar easily deflectable element, to allow the frame to be displaced if struck by a pitched ball and then, without assistance or readjustment, return to its initial position. Also, it is desirable that the support post 108 also be elevationally adjustable so that the lower frame member 106, defining the lower boundary of the strike zone, can be selectively repositioned. The base member 110 preferably houses a battery 116 and an enclosure 118 for electronic components of the device which are described below in greater detail. Also, the base member 110 preferably has a velocity, or speed, numeric display panel 120, and a pair of light displays 122,124 for indicating balls or strikes. The speed, ball and strike displays are desirably mounted on the base member 110 at a position that is easily observable by the pitcher.

Preferably, the tubular upper and lower frame members 104,106 are constructed of a plastic material such as acrylonitrile-butadiene-styrene (ABS), polycarbonate, polyester, polyethylene, ultrahigh-molecular-weight polyethylene (UHMWPE), polybutylene, polyurethane, and polyvinyl chloride (PVC). As an assembly aid, the straight horizontal and vertical components of the frame members 104,106 may be sections cut from a long pipe, and then joined at the corners of the U-shape by elbows. Importantly, the upper and lower frame members 104,106 have a core 126 constructed of a resilient foam material such as polyurethane or a foamed elastomer.

The resilient core 126, in cooperation with the tubular shell of the frame members 104,106 provides a shock resistant environment for a plurality of electromagnetic energy transmitters 128 mounted in the horizontal component of the lower frame member 106, and a plurality of electromagnetic energy receivers 130 mounted in the horizontal component of the upper frame member 104. In the preferred embodiment of the present invention, the electromagnetic energy transmitters 128 are narrow beam AlGaAs infrared-emitting diodes and the electromagnetic energy receivers 130 are infrared detectors. Other electromagnetic energy transmitters and receivers such as laser diodes, UV transmitters, or visible light sources with appropriate receivers capable of detecting emissions in the associated energy spectrums, may be used. However, these alternative transmitters and detectors have inherent disadvantages, such as cost, detection sensitivity, energy requirements and circuit complexity.

Each of the IR diode transmitters 128 is horizontally aligned with a vertically spaced IR detector 130 so that, in operation, each aligned pair cooperate to establish a vertically disposed plane. or electromagnetic energy curtain, 132 extending between the lower and upper horizontal components of the frame 102, and bounded on the sides by the vertical components of the frame 102. In the preferred embodiment of the present invention, the side components of the frame are spaced apart by about 30 inches (0.76 m).

Figure 5:
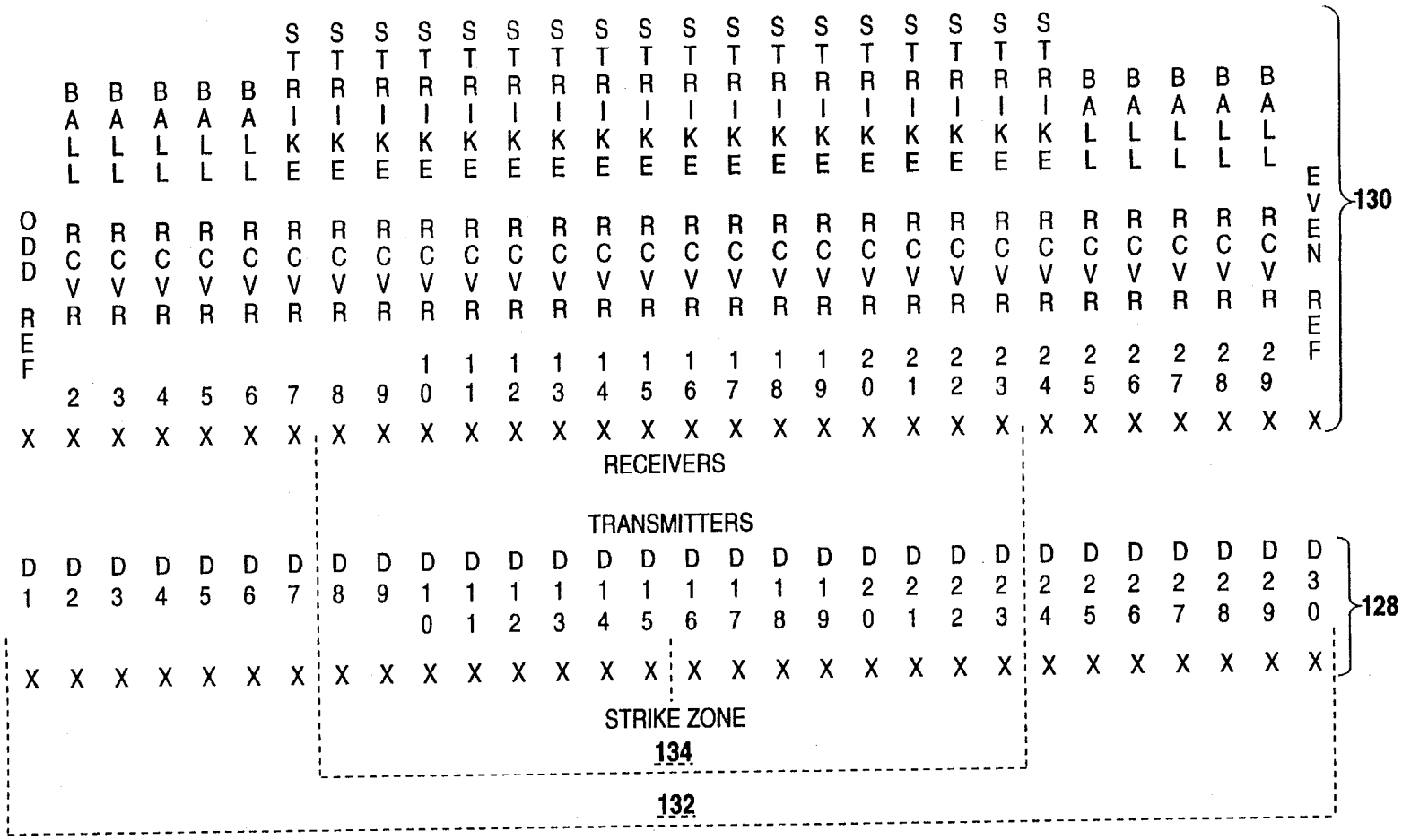
FIG. 5 is a schematic diagram of the linearly arrayed electromagnetic energy transmitters and receivers shown in the block diagram of FIG. 4.

In carrying out the method for measuring the velocity of a baseball according to the present invention, the degree of accuracy of the velocity measurement will directly correlate with the horizontal spacing between adjacent pairs of the transmitters 128 and receivers 130. That is, the closer together the transmitters and receivers are positioned, the more consistent will be the accuracy of the velocity measurements. On the other hand, fewer transmitters 128 and receivers 130 will lower the cost of the device 100. In the preferred embodiment of the present invention, 30 IR transmitters and 30 IR detectors were used, each spaced apart by about one inch, providing an accuracy band for the velocity measurement, when all of the system variables are included, of about 5%. Also, as shown in FIG. 1 and schematically in FIG. 5, and described later in additional detail, the centrally positioned receivers 130 are coupled together to effectively define a field, or strike zone, 134 having a width of about 18 inches (0.41 m) within the plane 132.

It is also desirable that each of the IR receivers 130 receive, as nearly as possible, the energy emission from only the single transmitter 128 that is aligned with the particular receiver. For that reason, as well as for the physical protection of the transmitters 128 and receivers 130 and for ambient light shielding of the receivers 130, each of these components are recessed in apertures 135 within each of their respective frame components. In the preferred embodiment of the present invention, the transmitters 128 and receivers 130 are each recessed a distance of 2.25 inches (5.7 cm) below the surface of the respective frame component in a bore hole having a diameter of 0.125 inches (0.3 cm).

In addition to using narrow beam IR transmitters and recessing both the transmitters 128 and receivers 130 to attenuate the potential for the reception of energy from more than one transmitter, the transmitters 128 are arranged in two groups that transmit in alternate phases. For identification purposes the IR diode transmitters 128 and the IR receivers 130 are serially numbered from left to right in the frame 102, with the respective identifying numbers 1 through 30. As shown in block form in FIG. 4, the odd numbered transmitters 128 (i.e., 1., 3., 5., etc.) and the even numbered transmitters 128 (i.e., 2., 4., 6., etc.) are divided into a separate portions that emit a pulse of infrared energy on alternating half cycles of a clock signal. Thus, a detector 130 will receive a strong pulse from its aligned transmitter 128 on each transmitting cycle of that transmitter, and a weaker, diffused pulse from the two transmitters adjacent the aligned transmitter at the half cycle. This important feature not only allows the use of a lower voltage source to drive the transmitters since only one-half of the transmitters are emitting an IR signal at any one time, but also enables the detection circuitry to accurately sense the interruption of a discrete, single emitted beam.

Figure 4:
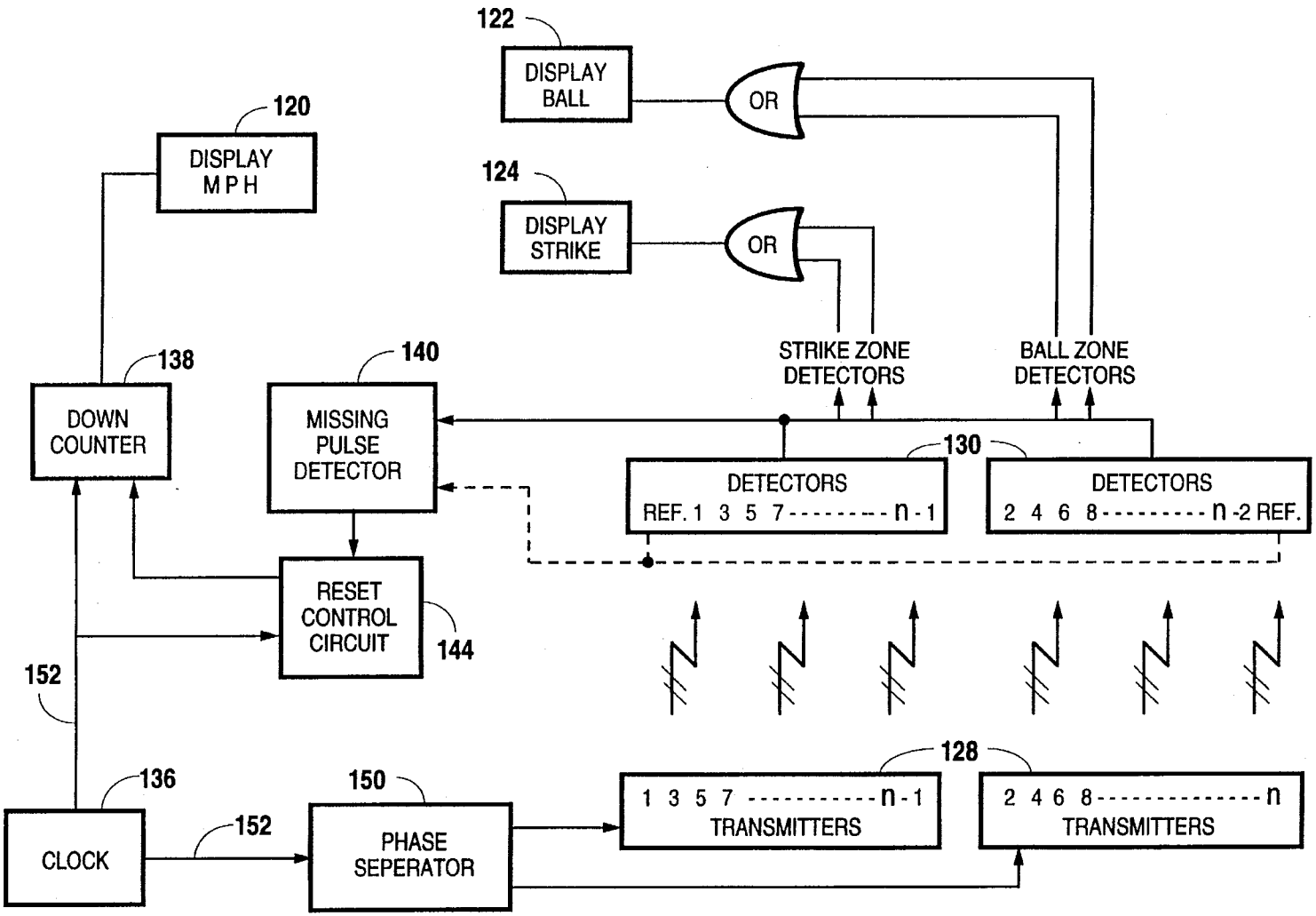
FIG. 4 is a block diagram showing the principal electrical components a device, embodying the present invention, for measuring the velocity and zonal position of a pitched ball.

Turning now to the block diagram shown in FIG. 4, the device 100 embodying the present invention further includes a clock 136 that, for reasons that are more fully explained later, emits a signal 138 at a frequency determined by the size of the object passing through the plane 132 at a predetermined speed. For example, in the preferred embodiment, the desired clock frequency was determined to be 586.67 Hz. One time length of cycle at this frequency corresponds to the time it takes for a ball having a diameter of 3 inches to pass a single point at 100 miles per hour. Upon detection of the first missed pulse, a reset control circuit 144 resets the down counter 138 to 99 and the number of cycles during which the IR pulse at 586.67 Hz is blocked, i.e., the time during which the detectors 130 do not detect a pulse, are then sensed by a missing pulse detector, counted by the down counter 138 and subtracted from 100. For example, if 20 pulses are counted as missing, the down counter will count from 100 down to 80 before again detecting a pulse, and 80 will be the measured speed of the ball in miles per hour. After counting the missing pulses, the measured speed value is displayed on a conventional LED or LCD numeric display 120, Alternatively, an "up" counter could be used with the speed value determined by subtracting the counted missing pulses from the clock period calculated ball speed.

The infrared receivers 130 are grouped together as described above and shown in FIG. 5, to define the inclusive field 134 representing a strike zone. The position of the receiver 130 delivering the last sensed missing pulse signal is used to determine the location of the ball within the plane 132. For this reason, 18 of the receivers 130, (RCVR 7 through RCVR 24) are grouped together to identify a strike and deliver a signal to the strike indicator 124 such as a green light mounted on the base member 110 or an audio device that audibly announces, "Strike!". Except for the very end receivers (RCVR 1 and RCVR 30, the receivers 130 on each side of the strike zone 134, (RCVR 2 through RCVR 6, and RCVR 25 through RCVR 29) are grouped together to identify a ball, and deliver a signal to the ball indicator 122 such as a red light mounted on the base member 110 or a device that delivers an audible expression, "Ball!".

Importantly, each of the end IR receivers 130 (RCVR 1 and RCVR 30) provide a first output signal 146 that is correlative of the ambient light environment in which the device 100 is operating. The first output signal 146 is used as a reference signal with which the output from the other receivers (RCVR 2 through RCVR 29), referred to herein as a second output signal 148, or gate signal, is compared. The reference signal 146 delivered by the first IR receiver 130 (RCVR 1) is compared with the second output signal 148 of the remaining odd-numbered receivers 130. Similarly, the reference signal 146 delivered by the last IR receiver 130 (RCVR 30) is compared with the remaining even-numbered receivers 130.

Figure 6:
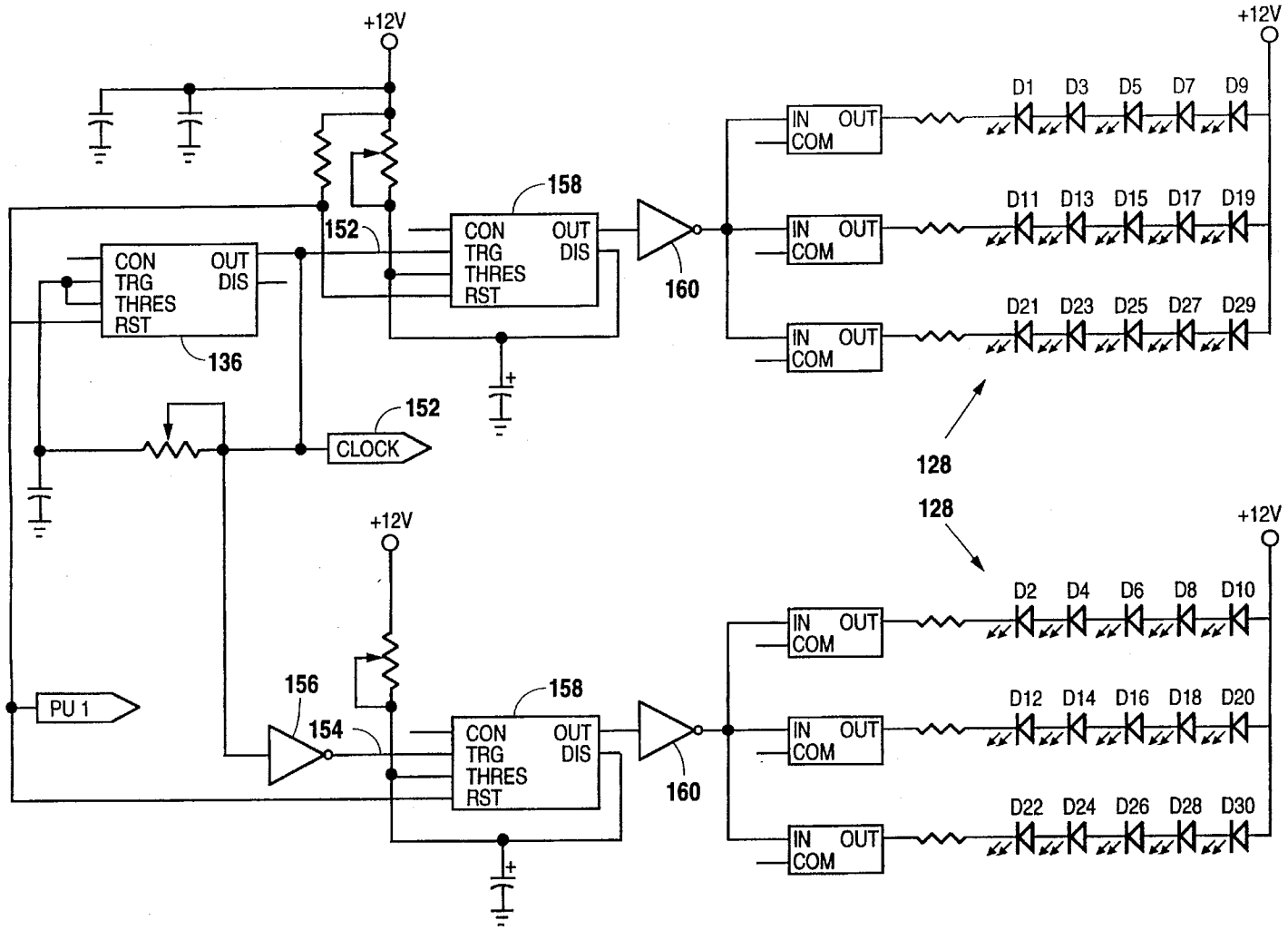
FIG. 6 is an electrical schematic diagram of the clock, phase separator, and transmitter components of the device embodying the present invention that are shown in block form in the diagram of FIG. 4.

The clock 136, a phase separator 150, and the IR infrared-emitting diodes 128 are shown in the circuit diagram of FIG. 6. In the preferred embodiment of the present invention, the clock 136 is a basic TLC555 timer component with a capacitor and resistor to create a clock signal 152 having a frequency, as described above, of 586.67 Hz and a 50% duty cycle. An inverted clock signal 154 is generated by directing the clock signal 152 through an inverter 156. If the duty cycle of the IR diodes 128 is restricted to about 10%, they are capable of operating at a desirable higher output and an overall lower power consumption. For this purpose, two additional TLC555 components, used as monostables 158, that is, as first and second signal generators to provide first and second phased drive signals 160 to the transmitters 128 that during only about 10% of each cycle.

Figure 9:
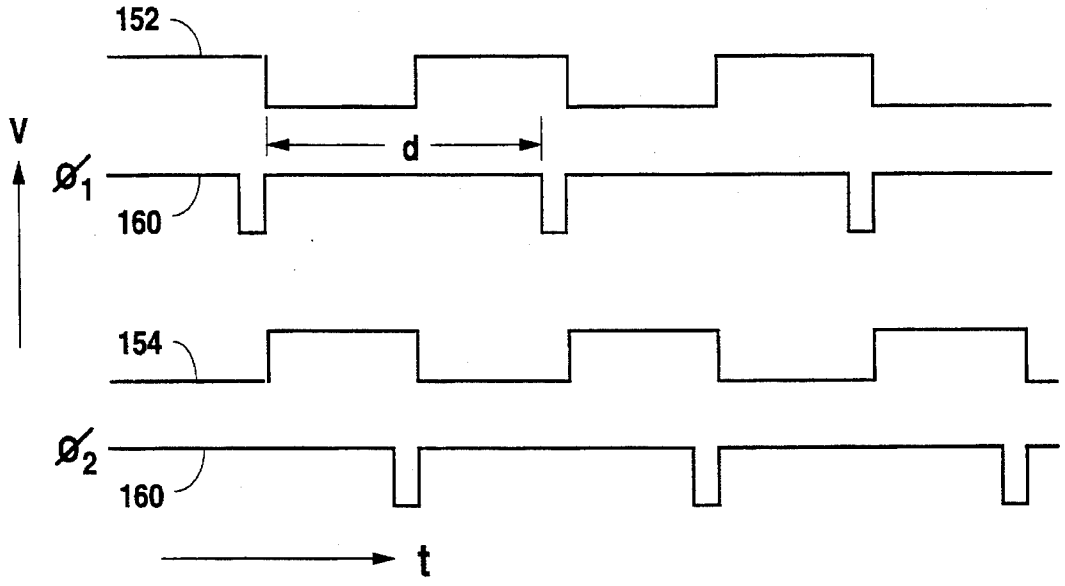
FIG. 9 is a diagrammatic representation showing waveforms representative of clock and phased drive signals useful in describing the operation of the device embodying the present invention.

As illustrated graphically in FIG. 9, on the falling edge of the clock signal 152, a delay d starts which keeps the monostable output high through 90% of the period before the clock signal goes low again. The low pulse of the monostable 158 is the time during which the IR diodes 128 are turned on. By generating an inverted clock signal 154, one half of the IR diodes 128, i.e., the odd-numbered diodes can be driven off the falling edge of the clock signal 152, by a first phase pulse signal $\Phi_1$ and the other half, i.e., the even-numbered diodes, can be driven off the falling edge of the inverted clock signal 154, by a second phase pulse signal $\Phi_2$. Therefore, the inverter 156 is used as the phase separator 150 to create the second phase pulse signal $\Phi_2$ that is separated by one half of the period of the clock signal 152.

As can be seen in FIG. 6, the 30 IR transmitters 128 are desirably divided into 6 groups of 5 diodes each. This enables the use of a 12 volt DC power supply to drive the transmitters 128, which can be readily provided by 8 D cell batteries or, alternatively, by a conventional garden tractor, marine or automotive battery.

Figure 7:
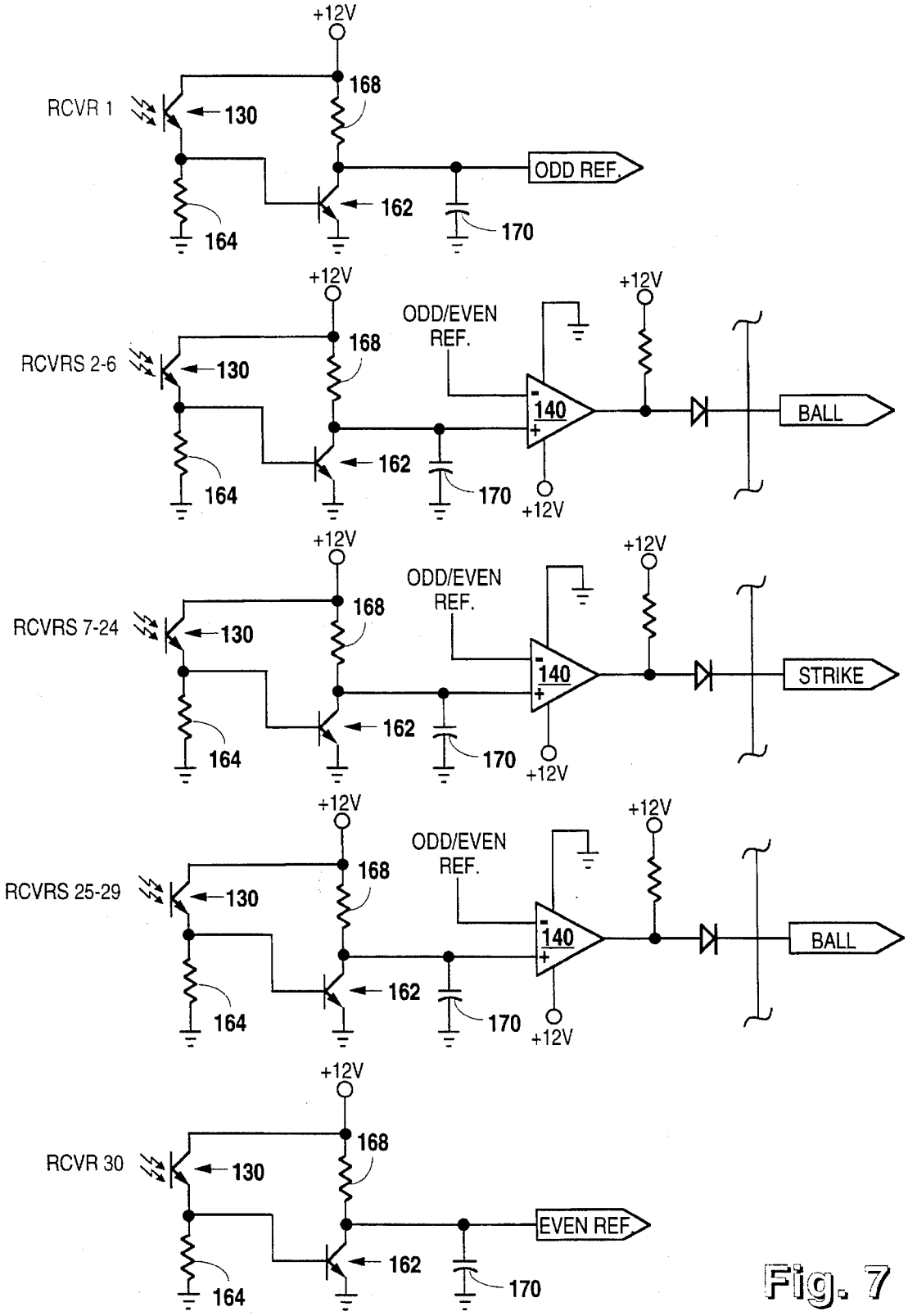
FIG. 7 is an electrical schematic diagram of the electromagnetic receiver, missing pulse detector and OR logic gate components of the device embodying the present invention that are shown in block form in the diagram of FIG. 4.

With reference now to FIG. 7, the infrared detectors 130 detect a low level of light at the sensor, amplify the signal by use of an NPN transistor 162, and provide and output signal. The output signal from the first IR receiver circuit (RCVR 1) is used as the reference signal 146 for the odd-numbered receiver circuits (RCVR 3, RCVR 5, RCVR 7, etc.), and the output signal from the last IR receiver circuits (RCVR 30), is used as the reference signal 146 for the even-numbered receiver circuits (RCVR 2, RCVR 4, RCVR 6, etc.). When no light is received by the detector 130 (OFF condition), very little current is leaked through the photodetector. However, with even a small amount of light (ON condition) the output of the detector 130 is very small and must be amplified. For this purpose, the NPN transistor 162 is used as an amplifier in each of the receiver circuits.

When light strikes the detector 130, a current flows through a resistor 164 to create a positive voltage and current flow to turn on the transistor 162. When the transistor 162 turns on, current flows through a second resistor 168 to reduce the voltage at the collector of the transistor 162 to a minimum of $V_{ce}$ sat of the transistor 162. This also discharges a capacitor 170 connected to ground in parallel with the transistor 162. When light is removed, the transistor 162 is turned off and the voltage at the collector of the transistor 162 begins to rise at the R-C time constant of the second resistor 168 and the capacitor 170.

Figure 10:
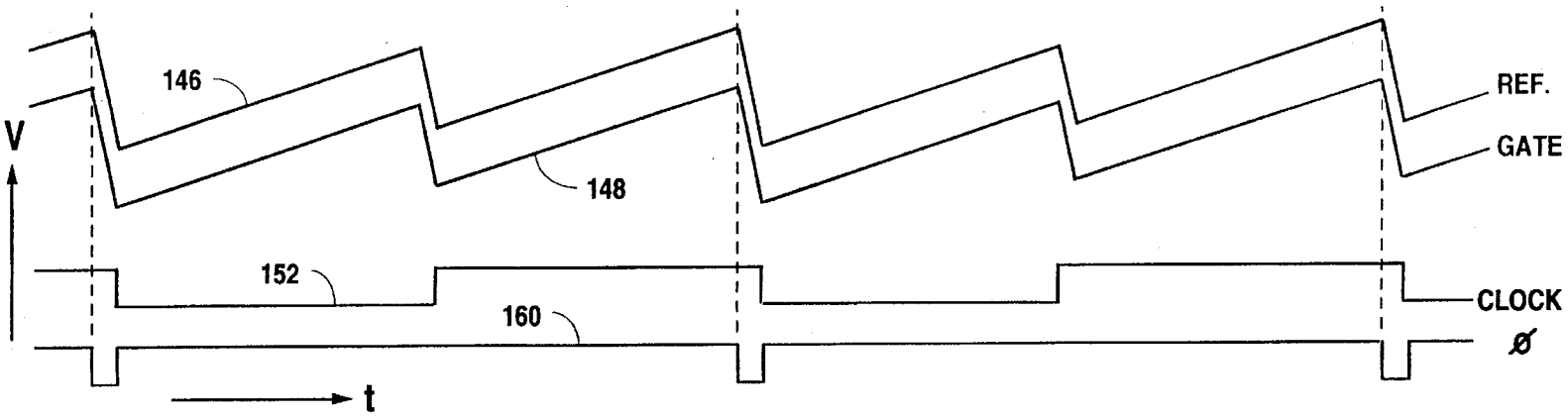
FIG. 10 is a diagrammatic representation of waveforms representative of typical reference, gate, clock and phased drive signals in the absence of sensing a ball passing through a detection plane, which are useful in describing the operation of the device embodying the present invention.

The device 100 is designed to operate under a variety of light conditions, e.g., indoors, at night on lighted fields, and in bright daylight, but probably never in total darkness. Under these conditions, there will always be some light sensed by the detectors 130, and therefore, some "turn on" of the receivers. Thus, the voltage at the collector of the transistor 162 in the receiver circuit will be lower when operating under bright sunlight than when operating indoors because it will be turned on more, and have a higher voltage when the ambient light is less. For this reason the end receivers (RCVR 1 and RCVR 30) are used to detect the ambient light condition and generate the reference signal 146 which is the output signal from the transistor 162. The relative relationship of the reference signal 146 with the output, or gate signal 148 from the other receiver circuits when an object is not blocking light to the receivers is shown diagrammatically in FIG. 10.

Because of their placement, the end receivers (RCVR 1 and RCVR 30) will be less exposed than any of the other receivers to diffused emissions from nonaligned transmitters because there will be transmitters on only one side of the transmitter with which they are aligned. This will result in less "turn on" during a sensed emission with a resulting higher voltage at the output of the receiver. To further assure that the output voltage of the reference signal 146 is higher than the normal (i.e., non-interrupted state) voltage of the gate signal 148 from the other receivers, a resistor 164 having a lower value for the end receiver circuits is used between the detector and ground. For example, the resistor 164, placed as shown in FIG. 7, has a value of 81KΩ in the end receiver circuits (RCVR 1 and RCVR 30) and a value of 100 kΩ for all other receiver circuits. Furthermore, to assure that the reference signal will not be interrupted by a pitched ball, it is desirable to have a physical barrier such as a rod 114 or an extension of a portion of the vertical frame component to shield the space between the end transmitters and detectors. Alternatively, the ambient light reference signal could be provided by a separate photodetector cell, or other light sensor, mounted on the base member 110 or elsewhere on the frame 102.

Figure 11:
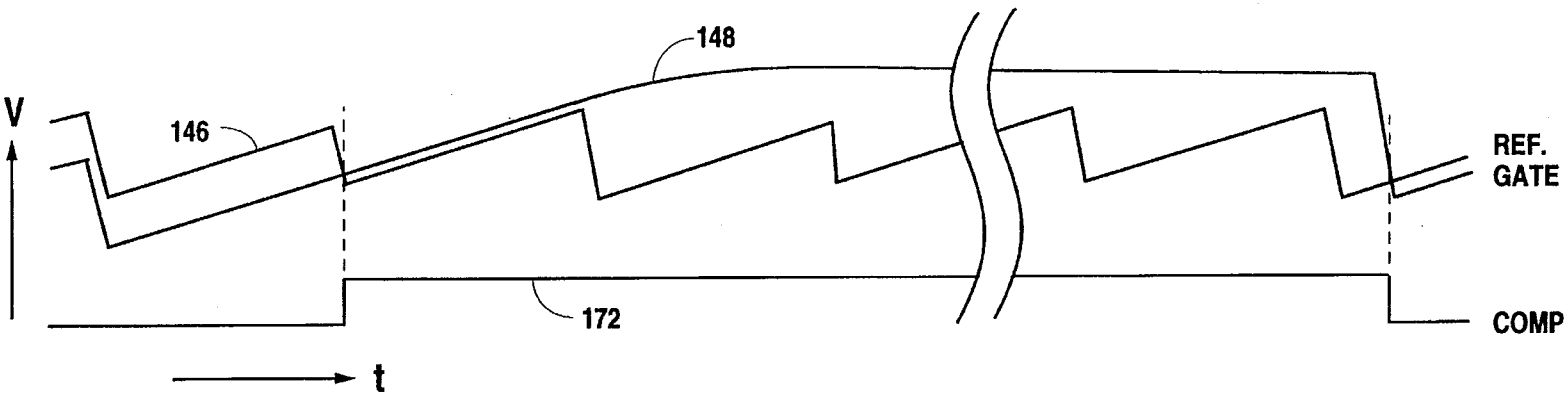
FIG. 11 is a diagrammatic representation of waveforms representative of the reference, gate and comparator signals during the passage of a ball through the detection plane, which are useful in describing the operation of the device embodying the present invention.

The output voltages of the transistors 162, i.e., the second output, or gate, signal 148 from the object sensor receiving circuits (RCVR 2 through RCVR 29) is compared by a comparator, i.e., the missing pulse detector 140, with the corresponding output voltages of the transistors 162 i.e., the odd or even reference signal 146 from the end receiver circuits (RCVR 1 or RCVR 30). As long as the gate voltage 148 is less than the reference voltage 146, the output of the comparator is at a logic low. However, when the gate voltage 148 exceeds the reference voltage 146, the output of the comparator goes to a logic high, which is used as an event, or COUNT signal 172 to initiate the count down timer 138. This relationship is shown in diagrammatic form in FIG. 11. The gate voltage 148 will exceed the reference voltage 146 if the lighted emitted by a transmitter 128 fails to reach an aligned detector 130, thereby keeping the transistor 162 off and allowing the gate voltage to continue to charge at the R-C time constant described above. Once the transmitted light is restored to the detector 130, the transistor 162 is turned on and the gate voltage is lowered to a value less than the reference voltage.

The receiver circuitry described above is replicated for IR receivers 130 positioned across the width of the field 134 defining the strike zone, and may be extended and reasonable length on either side of the field. The receivers 130 wired ANDed together and then separated by diodes to segregate whether the detection was by a ball crossing the "plate", or outside the "plate". Thus, in the preferred embodiment described herein, RCVR 1 is used to provide the reference signal 146 for the remaining odd-number receivers. RCVR 7 through RCVR 24 are wired together and provide a third signal in response to a ball crossing the "plate, i.e., through the field 134. RCVR 2 through RCVR 6 and RCVR 25 through 29 are wired together and provide a fourth signal in response to a ball crossing the plane 132 outside the "plate". RCVR 30 is used to provide the reference signal 146 for the remaining even-numbered receivers.

Figure 8:
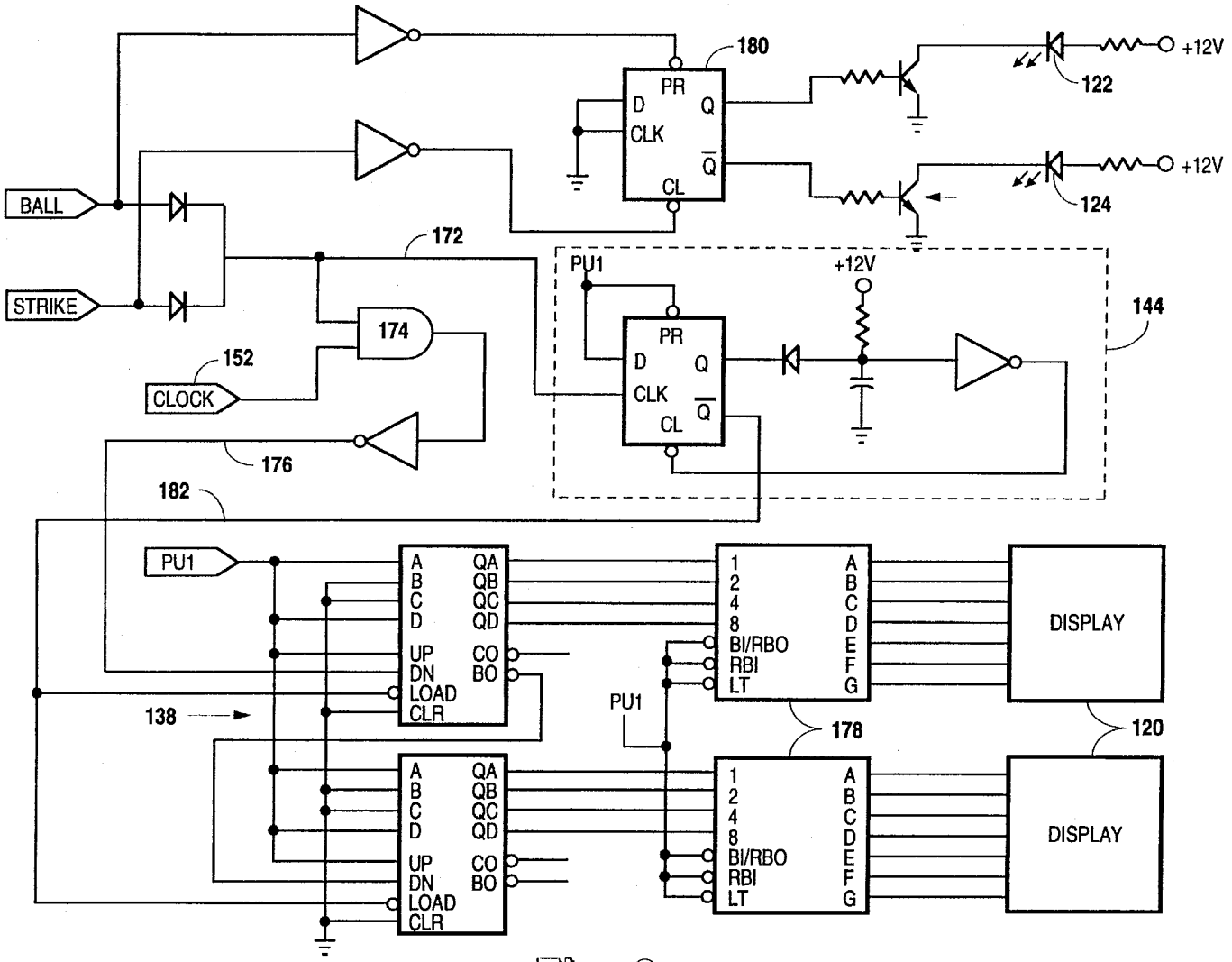
FIG. 8 is an electrical schematic diagram of the down counter, reset, and velocity, ball and strike display components of the device embodying the present invention that are shown in block form in the diagram of FIG. 4.

The clock 136 used to drive the IR transmitters 128 is also used to deliver a clock signal 152 at the aforementioned frequency of 586.67 Hz to the down counter 138. When any one of the comparators 140 goes to a high logic state indicating a gate value greater than the reference value for that particular receiving circuit, it enables the down counter 138 to "begin counting". Likewise, when all detectors resume detecting pulses, the counter must "stop counting". With reference now to FIG. 8, the ORed output of the comparators 140, create a DETECT signal 172 which is ANDed with the CLOCK signal 152 to create a COUNT signal 176 which is applied to the down count circuit 138 that uses two 74C192 BCD counters, counting down from 99. The reset control circuit 144 is used to load the counter circuit 138 by using a one shot circuit to create a very short LOAD pulse signal 182. When the DETECT signal 172 is high, the AND is enabled and the COUNT signal 176 begins to count down the counter 138 until DETECT signal 176 again goes low. The value remaining in the counter represents the speed of the ball and remains in the counter until the next LOAD pulse signal 182 is received.

The output of the counter circuit 138 is delivered to a driver circuit 178 which, in the preferred embodiment, uses two 74C48 LED driver chips to operate the LED numeric display panel 120. Alternatively, the output of the counter circuits 138 could be used as an input to an audio generation device that would provide an audible output of the speed.

As described above, the ORed and segregated detector circuits also provide the output to the flip-flop 180 which is used as a discriminator to deliver an appropriate drive signal to either the "Ball" or "Strike" signal devices 122,124. As mentioned earlier, this signal may alternatively be used to generate an audio indication of a "Ball" or "Strike".

Thus, the signal comparators 140, the count down timer 138, the velocity display 120 and the strike or ball display indicators 122,124, in cooperation with their associated circuitry, all cooperate to provide a means for detecting the entry and exit of a ball passing through the plane 132 and simultaneously detecting the passage of at least a portion of the ball through the field, or strike zone, 134 within the plane 132.

It will also be apparent to one skilled in the electronic arts that alternative circuit components could be used to accomplish the same results. The method for measuring the velocity and zonal position of a pitch ball using the above described device 100 includes sensing the entrance and exit of a ball in flight, into and out of a single spatial plane 132. A series of count, or clock, signals 152 are generated at a predetermined frequency that is selected to correlate with the diameter the ball and the elapsed time it take the ball to completely pass through the plane 132 at a preselected velocity. The number of counts occurring during the time the ball enters and the time the ball exits the plane 132 are measured, and the velocity of the ball as it passes through the plane 132 is determined. A value representative of the determined velocity is displayed. Simultaneously with sensing the passage of the ball through the plane 132 the zonal position of the ball with respect to the plane 132 is also sensed. More specifically, the passage of the ball either through a predefined planar field 134 with the plane 132 or outside of the predefined field 134 is sensed, and a signal is displayed indicative of which path the ball traversed, i.e., either through or outside of the field 134 If the ball passed through the field, a "Strike" would be indicated, and if outside the field a "Ball" would be indicated.

The steps of sensing the entrance and exit of the ball through the single plane 132 preferably includes emitting a plurality of pulsed electromagnetic energy signal at the a preselected frequency, desirably at the same frequency as the aforementioned predetermined frequency. Preferably about half of the pulsed electromagnetic energy pulses have are in a first phase relationship with the aforementioned clock signal 152, and the other half of the pulses are in a second phase relationship with the clock signal 152. It is advantageous if the first and second phased relationships are separated by a half period of the preselected frequency.

The method for measuring the velocity and zonal position of a baseball also preferably includes sensing the ambient light environment in which the device 100 is being used, and generating a reference signal that is correlative of the ambient light. The reference signal is then compared with the emitted electromagnetic energy signal and the number of count signals occurring during the time in which the value of any one of the sensed electromagnetic energy signals has a value greater than the reference value is measured.

Industrial Applicability

The device 100 for measuring the velocity and zonal position of a pitched ball is compact, easily transportable and relatively inexpensive to produce. The device requires only a single linear array of electromagnetic energy transmitters and a single linear array of electromagnetic energy receivers. Preferably, the transmitters are inexpensive infrared-emitting diodes, and the receivers are, likewise, inexpensive photoelectric detectors. All of the electronic circuitry is easily mountable in the base 110 of the device 100, and the device can be operated for extended periods of time with a 12 volt battery. Moreover, the device 100 is able to operate under a wide variety of light conditions, whether they be indoors, outside at night in a lighted field, or in bright daylight.

Because the device 100, embodying the present invention, for measuring the velocity and zonal position of a pitched ball has fewer components and is accordingly less expensive to produce, it is particularly suitable for use by a large population of baseball players that want to improve the speed or accuracy with which they can throw a ball. Thus the present invention provides a desirable training aid that can be used by players, coaches and trainers at the school, college or university, or even professional sports level.

Other aspects, features and advantages of the present invention can be obtained from a study of this disclosure together with the appended claims.

DEVICE AND METHOD FOR MEASURING THE VELOCITY AND ZONAL POSITION OF A PITCHED BALL

ELEMENT LIST

Figure 2:
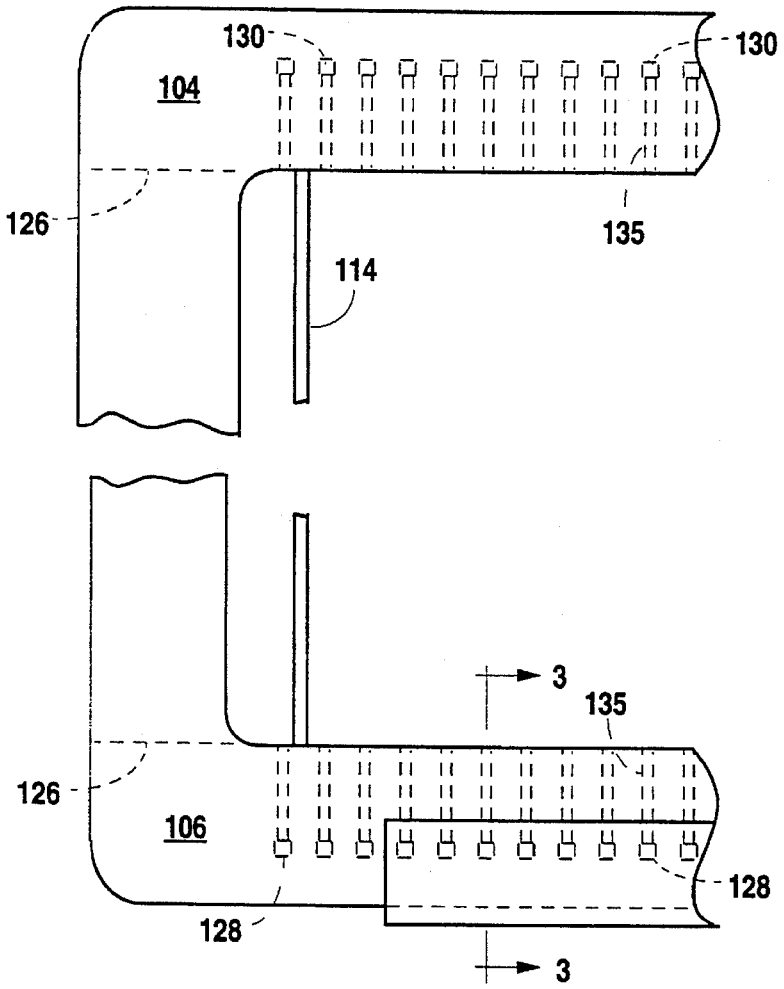
FIG. 2 is an enlarged elevational view of upper and lower sections of the support frame of the device embodying the present invention shown in FIG. 1.
Figure 3:
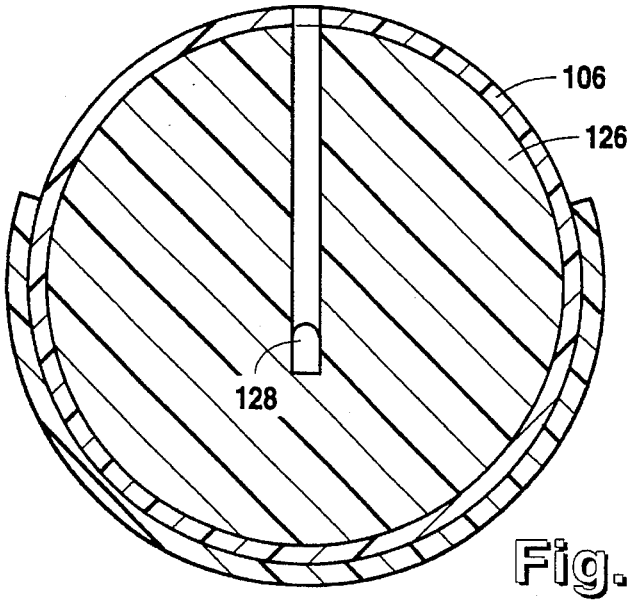
FIG. 3 is a sectional view of the support frame of the device embodying the present invention, taken along the line 3—3 of FIG. 2.

| | |
|---|---|
| →100 | Device |
| →102 | Frame |
| 104 | Upper Tubular Member |
| 106 | Lower Tubular Member |
| 108 | Support Post |
| 110 | Base Member |
| 112 | Spring |
| 114 | Rod (in FIGS. 1 and 2) (next to vertical frame components) |
| 116 | Battery |
| 118 | Electronic Component Box |
| 120 | (Speed) Numeric Display Panel |
| 122 | Ball Indicator |
| 124 | Strike Indicator |
| 126 | Core |
| 128 | Electromagnetic Energy Transmitters (Infrared-Emitting Diodes) |
| 130 | Electromagnetic Energy Receivers (Infrared Detectors) |
| 132 | Plane |
| 134 | Field |
| 135 | Apertures |
| 136 | Clock |
| 138 | Down Counter |
| 140 | Missing Pulse Detector |
| 144 | Reset Control Circuit |
| 146 | First Output (Reference) Signal |
| 148 | Second Output (Gate) Signal |
| 150 | Phase Separator |
| 152 | Clock Signal |
| 154 | Inverted Clock Signal |
| 156 | Inverter |
| 158 | Monostable |
| 160 | Phased Pulse Signal |
| 162 | NPN Transistor |
| 164 | Resistor (130 to ground) |
| 168 | Resistor (162 to Ref V) |
| 170 | Capacitor (168 to Ground) |
| 172 | Event (Detect) Signal |
| 174 | Anded output of 172 "[?]" symbol in FIG. 8) |
| 176 | Count signal |
| 178 | Driver Circuit |
| 180 | Flip Flop |
| 182 | Load Pulse Signal |

What we claim is:

1. A device for measuring the velocity and zonal position of a pitched ball, comprising:

a plurality of electromagnetic energy transmitters arranged in a single linear array;

a plurality of electromagnetic energy receivers arranged in a single linear array and cooperating with said electromagnetic energy transmitters to define a single vertical plane having laterally spaced end boundaries, a preselected portion of said electromagnetic energy receivers being electrically coupled together and defining a field within said plane;

a means for separately detecting the entry and exit of a ball passing through said plane and simultaneously detecting the passage of at least a portion of said ball through the field within said plane.

2. A device for measuring the velocity and zonal position of a pitched ball, as set forth in claim 1, wherein said device includes at least one sensor for detecting the ambient light environment in which the device is operating and delivering a first output signal correlative of said ambient light environment.

3. A device for measuring the velocity and zonal position of a pitched ball, as set forth in claim 2, wherein said sensor comprises at least one of the electromagnetic energy receivers arranged in said linear array.

4. A device for measuring the velocity and zonal position of a pitched ball, as set forth in claim 3, wherein said first output signal is a reference signal and the electromagnetic energy receivers other than said at least one receiver each deliver a second output signal, all of said second output signals having a value less than the value of said reference signal when said ball is not passing through said plane and a portion of said second output signals having a value greater than said reference signal in response to said ball passing through at least a portion of said plane.

5. A device for measuring the velocity and zonal position of a pitched ball, as set forth in claim 4, wherein said detecting means includes a plurality of signal comparators, a countdown timer, a velocity display panel and a strike zone display apparatus, each of said signal comparators being in electrical communication with a respective one of said other receivers and delivering an event signal to said countdown timer in response to the value of the second output signal of the communicant receiver being greater than said reference signal, and said countdown timer delivering a measured elapsed count signal to said velocity display panel determined by a time interval measured between the time at which an event signal is delivered by at least one of said comparators and the time at which no event signals are delivered by any of said comparators.

6. A device for measuring the velocity and zonal position of a pitched ball, as set forth in claim 5, wherein said device includes a clock and at least one signal generator, said clock delivering a preselected frequency time signal to said signal generator, said signal generator delivering a drive signal to said electromagnetic energy transmitters at said preselected frequency, and said transmitters emitting a pulse of electromagnetic energy at said preselected frequency in response to receiving said drive signal.

7. A device for measuring the velocity and zonal position of a pitched ball, as set forth in claim 6, wherein said device includes a first and a second signal generator, said first signal generator delivering a drive signal to a first portion of said electromagnetic energy transmitters in a first phased relationship with said time signal, and said second signal generator delivering a drive signal to a second portion of said electromagnetic energy transmitters in a second phased relationship with said time signal, said first and second phased relationships being separated by a half period of said preselected frequency time signal.

8. A device for measuring the velocity and zonal position of a pitched ball, as set forth in claim 6, wherein a selected one of said first portion of electromagnetic energy receivers and a selected one of said second portion of said electromagnetic energy receivers each deliver a first output signal correlative of the ambient light environment in which said device is operating.

9. A device for measuring the velocity and zonal position of a pitched ball, as set forth in claim 8, wherein the selected one of the first and second portions of the energy receivers are respectively positioned adjacent one of said end boundaries defining said plane.

10. A device for measuring the velocity and zonal position of a pitched ball, as set forth in claim 5, wherein the preselected portion of said electromagnetic energy receivers electrically coupled together to define a field within said zone deliver a third signal to said strike zone display device in response to a ball passing through at least a portion of said field and the electromagnetic energy detectors other than said preselected portion deliver a fourth signal to said strike zone display device in response to a ball passing through the portion of said plane exclusive of said field.

11. A device for measuring the velocity and zonal position of a pitched ball, as set forth in claim 1, wherein said electromagnetic energy transmitters are infrared-emitting diodes and said electromagnetic energy receivers are infrared detectors.

12. A device for measuring the velocity and zonal position of a pitched ball, as set forth in claim 1, wherein the device includes a frame having vertically spaced upper and lower horizontal members, said electromagnetic energy transmitters being mounted within a recessed aperture in said lower horizontal member and said electromagnetic energy receivers being mounted within a recessed aperture in said upper horizontal member.

13. A device for measuring the velocity and zonal position of a pitched ball, as set forth in claim 12, wherein said frame is resiliently mounted on a movable base.

14. A method for measuring the velocity and zonal position of a pitched ball, comprising:

sensing the entrance of a ball in flight into a single predefined spatial plane;

sensing the exit of said ball from said single spatial plane;

generating a series of count signals at a predetermined frequency, said frequency being selected to correlate with the diameter of said ball and the elapsed time occurring during the passage of said ball through said single spatial plane at a preselected velocity;

measuring the number of count signals occurring between the entrance into and the exit from said single spatial plane;

determining the instantaneous velocity of said ball based on the number of said measured count signals;

displaying a value indicative of said determined instantaneous velocity;

sensing the passage of said ball either through a predefined planar field within said single spatial plane or outside of said predefined planar field simultaneously with said sensing the entrance and exit of said ball through the single spatial plane, and displaying a signal indicative of the position of said ball relative to said predefined planer field at the time said ball passes through said single spatial plane.

15. A method for measuring the velocity and zonal position of a pitched ball, as set forth in claim 14, wherein the steps of sensing the entrance and exit of said ball through said single spatial plane includes emitting a plurality of pulsed electromagnetic energy signals at a preselected frequency, a first portion of said pulsed electromagnetic energy signals being in a first phased relationship with said preselected frequency and a second portion of said pulsed electromagnetic energy signals being in a second phased relationship with said preselected frequency, said first and second phased relationships being separated by a half period of said preselected frequency.

16. A method for measuring the velocity and zonal position of a pitched ball, as set forth in claim 15, wherein said preselected frequency at which the electromagnetic energy pulses are emitted is the same frequency as said predetermined frequency at which a series of count signals are generated.

17. A method for measuring the velocity and zonal position of a pitched ball, as set forth in claim 15, wherein the step of measuring the number of count signals occurring between the sensed entrance into and the sensed exit from said single spatial plane, includes:

sensing the ambient light environment in which the steps of sensing the entrance and exit of said ball through said single spatial plane is being carried out;

generating a reference signal correlative of said ambient light environment;

sensing said emitted pulsed electromagnetic energy signals;

comparing said sensed emitted pulsed electromagnetic energy signal with said reference signal; and measuring the number of count signals occurring during a period in which the value of any one of said sensed emitted pulsed electromagnetic energy signals has a value greater than said reference value.

* * * * *